US010463226B2

(12) United States Patent
Mesa et al.

(10) Patent No.: US 10,463,226 B2
(45) Date of Patent: Nov. 5, 2019

(54) SUPPORT ASSEMBLY

(71) Applicant: ELECTROLUX APPLIANCES AKTIEBOLAG, Stockholm (SE)

(72) Inventors: Daniel Mesa, Stockholm (SE); Rickard Hederstierna, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 15/323,067

(22) PCT Filed: Sep. 1, 2014

(86) PCT No.: PCT/EP2014/068529
§ 371 (c)(1),
(2) Date: Dec. 29, 2016

(87) PCT Pub. No.: WO2016/034202
PCT Pub. Date: Mar. 10, 2016

(65) Prior Publication Data

US 2018/0146837 A1 May 31, 2018

(51) Int. Cl.
*A47L 15/50* (2006.01)

(52) U.S. Cl.
CPC ..... *A47L 15/503* (2013.01); *A47L 15/505* (2013.01); *A47L 15/501* (2013.01)

(58) Field of Classification Search
CPC ..... A47L 15/503; A47L 15/505
(Continued)

(56) References Cited

U.S. PATENT DOCUMENTS 572,770 A * 12/1896 Putnam ..... B62H 3/12 211/19
1,350,351 A * 8/1920 Abbott ..... A47L 19/04 211/41.4

(Continued)

FOREIGN PATENT DOCUMENTS

CN 201061516 Y 5/2008
CN 101977539 A 2/2011

(Continued)

OTHER PUBLICATIONS

International Search Report and Written Opinion for Application No. PCT/EP2012/076769 dated Feb. 11, 2013.

(Continued)

*Primary Examiner* — Jonathan Liu
*Assistant Examiner* — Devin K Barnett
(74) *Attorney, Agent, or Firm* — Alston & Bird LLP

(57) ABSTRACT

A support assembly for supporting one or more objects in a dishwasher is provided. The support assembly may include a snap arrangement with snap fittings for snapping the snap arrangement onto a rack of the dishwasher. The support assembly may include a main frame having a first side and a second side, where the first side may be provided with a soft surface structure, and where the main frame may be foldably arranged to the snap arrangement to allow the main frame to be folded between at least a supporting position and a storing position. The soft surface structure of the first side may be arranged to support a portion of the one or more objects when the main frame is in the supporting position. The embodiments herein may also relate to a rack of a dishwasher and a dishwasher comprising a rack.

21 Claims, 5 Drawing Sheets

(58) Field of Classification Search
USPC ..... 211/41.1–41.4, 41.8, 41.9, 85.31, 85.5, 211/125, 168, 169, 170, 171, 163, 165, 211/167; 312/228.1; 134/135
See application file for complete search history.

(56) References Cited

U.S. PATENT DOCUMENTS 2,142,019 A * 12/1938 Warner ..... A47J 31/44 211/41.2
2,144,278 A * 1/1939 Wallace ..... F24C 15/16 126/339
2,213,918 A 9/1940 Lofstrand, Jr.
2,287,611 A * 6/1942 Harbison ..... F25D 25/02 108/62
2,708,037 A * 5/1955 Planeta ..... A47L 19/04 211/41.4
3,241,516 A * 3/1966 Hopkins ..... H01F 7/0252 116/173
3,295,696 A * 1/1967 Cohen ..... A47F 7/10 211/171
3,433,363 A * 3/1969 Clearman ..... A47L 15/505 211/41.8
3,473,756 A * 10/1969 Jones ..... D05B 91/14 211/59.1
3,512,227 A 5/1970 Krawagna
3,752,322 A 8/1973 Fiocca et al.
4,029,277 A 6/1977 Bulanda
4,406,372 A * 9/1983 Bell ..... A47F 7/024 206/493
4,437,572 A * 3/1984 Hoffman ..... A47F 5/13 108/60
4,589,556 A 5/1986 Peretz
4,606,464 A * 8/1986 Jordan ..... A47L 15/503 211/184
4,909,401 A * 3/1990 McConnell ..... A47J 47/16 211/41.8
5,042,418 A * 8/1991 Hoover ..... B60R 13/005 116/173
5,048,451 A * 9/1991 Reimers ..... B60Q 1/486 116/35 A
5,078,281 A * 1/1992 Johnson ..... B25H 3/06 211/88.01
5,103,582 A * 4/1992 Farmer ..... G09F 15/00 40/607.03
5,158,185 A * 10/1992 Michael ..... A47L 15/503 134/200
5,249,590 A * 10/1993 Jacobus ..... A47L 15/505 134/135
D342,005 S * 12/1993 Forsberg ..... D8/72
5,287,984 A * 2/1994 Michael ..... A47L 15/502 220/555
5,277,387 A 11/1994 Lewis et al.
5,363,792 A * 11/1994 Petechik ..... B60Q 1/50 116/28 R
5,431,294 A * 7/1995 Stottmann ..... A47L 15/502 211/181.1
5,483,916 A * 1/1996 Kolvites ..... F16M 11/10 116/173
5,505,318 A * 4/1996 Goff ..... A47B 46/00 211/132.1
5,572,776 A 11/1996 Murphy et al.
5,699,631 A * 12/1997 Tyson ..... G09F 7/04 40/493
6,109,455 A * 8/2000 Schroeder ..... A47L 15/505 211/41.9
6,123,204 A 9/2000 Nelson et al.
6,386,393 B1 * 5/2002 Paulovich ..... B67D 3/0029 211/80
6,394,285 B1 * 5/2002 Arthurs ..... A47L 15/505 211/41.9
6,546,942 B2 * 4/2003 Smith ..... A47L 15/503 134/201
D487,825 S * 3/2004 Kim ..... D32/3
6,913,233 B2 * 7/2005 Puett, III ..... F16B 5/0692 116/173
6,915,757 B2 * 7/2005 Urban ..... B60Q 7/005 116/173
6,932,312 B1 * 8/2005 Chen ..... B25B 5/06 211/60.1
D509,108 S * 9/2005 Rosenberg ..... D7/601
7,032,604 B2 * 4/2006 Welch ..... A47L 15/50 134/135
7,066,105 B2 * 6/2006 Tal ..... B60Q 1/50 116/173
7,209,345 B2 * 4/2007 Jang ..... F16L 3/12 313/404
D547,048 S * 7/2007 Conway ..... D3/10
7,458,471 B2 12/2008 Crudgington, Jr.
7,478,642 B2 * 1/2009 Koch ..... A47L 15/505 134/135
D586,861 S * 2/2009 Noble ..... D12/400
7,523,902 B2 4/2009 Almeida
7,543,712 B2 6/2009 Purushothaman
7,556,231 B2 7/2009 Herbst et al.
7,644,826 B2 * 1/2010 Koch ..... A47L 15/503 211/41.4
7,931,155 B2 * 4/2011 Bastuji ..... A47L 15/503 134/56 D
D642,039 S * 7/2011 Forsberg ..... D8/72
7,988,107 B2 8/2011 Miller et al.
8,522,998 B2 * 9/2013 Crookshanks ..... A47L 15/501 211/41.8
8,540,085 B2 * 9/2013 Klump ..... A47L 15/50 134/135
8,573,576 B2 * 11/2013 Clark ..... B25B 5/04 269/157
8,701,898 B2 * 4/2014 Chai ..... A47L 15/503 211/150
8,746,467 B2 * 6/2014 Jeong ..... A47L 15/502 211/126.2
9,326,604 B1 * 5/2016 Schuldt ..... A47B 96/04
D771,476 S * 11/2016 Prince ..... D8/373
9,788,673 B2 * 10/2017 Gschwind, Jr. .... A47G 23/0225
9,877,632 B2 * 1/2018 Roberson ..... A47L 15/505
2001/0000901 A1 * 5/2001 Kambouris ..... B65D 43/164 220/212
2003/0019998 A1 * 1/2003 Kou ..... B62J 11/00 248/534
2003/0084835 A1 * 5/2003 Chao ..... G09F 17/00 116/173
2004/0149668 A1 * 8/2004 Fann ..... A47B 73/002 211/74
2005/0109378 A1 * 5/2005 Landsiedel ..... A47L 15/14 134/135
2005/0236345 A1 * 10/2005 Herbst ..... A47L 15/503 211/41.9
2005/0242046 A1 * 11/2005 Lee ..... A47L 15/503 211/41.9
2005/0268945 A1 * 12/2005 Hedstrom ..... A47L 15/503 134/25.2
2006/0086307 A1 * 4/2006 Kaz ..... G09F 21/04 116/28 R
2006/0108298 A1 * 5/2006 Kim ..... A47L 15/503 211/41.8
2006/0113260 A1 * 6/2006 Purushothaman .... A47L 15/505 211/41.8
2006/0138064 A1 * 6/2006 Crudgington, Jr. ... A47L 15/505 211/41.9
2006/0169652 A1 * 8/2006 Yang ..... A47G 21/14 211/41.3
2006/0185698 A1 * 8/2006 Adasch ..... A47L 15/505 134/135
2006/0237042 A1 * 10/2006 Weaver ..... A47L 15/504 134/25.2
2006/0243681 A1 * 11/2006 Bastuji ..... A47L 15/502 211/41.8
2006/0254992 A1 * 11/2006 Lim ..... A47L 15/505 211/41.9

(56) References Cited

U.S. PATENT DOCUMENTS

2006/0254993 A1* 11/2006 Lee ..... A47L 15/505 211/41.9
2006/0254994 A1* 11/2006 Lim ..... A47L 15/505 211/41.9
2006/0289038 A1 12/2006 Hedstrom et al.
2007/0039904 A1* 2/2007 Purushothaman .... A47L 15/503 211/41.8
2007/0131696 A1* 6/2007 Schessl ..... A47L 15/503 220/489
2007/0137501 A1* 6/2007 Manuel ..... F24C 15/16 99/450
2007/0163626 A1 7/2007 Klein
2007/0247039 A1* 10/2007 Anderson ..... A47L 15/0084 312/228.1
2008/0110480 A1* 5/2008 Choi ..... A47L 15/503 134/135
2008/0116155 A1* 5/2008 Yang ..... A47L 19/04 211/41.3
2008/0149149 A1* 6/2008 Ryu ..... A47L 15/0065 134/135
2008/0156750 A1* 7/2008 Richardson ..... A47L 15/505 211/41.9
2008/0185352 A1 8/2008 O'Hara
2008/0302740 A1* 12/2008 Moser ..... A47L 15/503 211/41.8
2009/0090681 A1* 4/2009 Graute ..... A47L 15/505 211/41.9
2009/0120883 A1* 5/2009 Jadhav ..... A47L 15/503 211/41.9
2009/0301977 A1* 12/2009 Amaral ..... A47L 15/505 211/41.8
2010/0194254 A1* 8/2010 House ..... A47L 15/502 312/228.1
2011/0001415 A1* 1/2011 Park ..... F25D 25/02 312/408
2011/0011429 A1* 1/2011 Haltmayer ..... A47L 15/50 134/115 R
2011/0025179 A1* 2/2011 Haltmayer ..... A47L 15/503 312/228.1
2011/0192808 A1* 8/2011 Buhl ..... A47L 15/505 211/41.9
2011/0233158 A1* 9/2011 Haider ..... A47L 15/503 211/41.8
2011/0247990 A1 10/2011 Chai
2011/0253650 A1* 10/2011 Renz ..... A47L 15/503 211/41.9
2011/0290804 A1 12/2011 Kohles et al.
2012/0031861 A1* 2/2012 Haltmayer ..... A47L 15/503 211/41.9
2012/0056519 A1* 3/2012 Woo ..... A47L 15/503 312/228.1
2012/0139400 A1* 6/2012 Hofpeter ..... A47L 15/502 312/228.1
2012/0292270 A1* 11/2012 Klump ..... A47L 15/50 211/41.8
2012/0292273 A1* 11/2012 McNamara ..... A47L 15/503 211/79
2012/0306333 A1* 12/2012 Eng ..... A47L 15/505 312/228.1
2013/0002107 A1* 1/2013 Paschini ..... A47L 15/502 312/228.1
2013/0134115 A1* 5/2013 Hernandez-Ariguznaga ..... H05K 7/186 211/26
2013/0299438 A1* 11/2013 McDaniel ..... A47L 15/505 211/41.9
2013/0327366 A1* 12/2013 Godehardt ..... A47L 15/505 134/115 R
2014/0021149 A1* 1/2014 Eng ..... A47L 15/505 211/41.8
2014/0132136 A1* 5/2014 Kilic ..... A47L 15/503 312/228.1
2014/0137906 A1* 5/2014 Shin ..... A47L 15/504 134/135
2014/0285077 A1* 9/2014 Yoon ..... A47L 15/503 312/228.1
2015/0033604 A1* 2/2015 Bigham ..... G09F 17/00 40/591
2015/0053237 A1* 2/2015 Lee ..... A47L 15/4295 134/18
2015/0164301 A1* 6/2015 Bartloff ..... A47B 95/043 211/41.8
2015/0182104 A1* 7/2015 Jeong ..... A47L 15/502 134/92
2016/0037997 A1* 2/2016 Mesa ..... A47L 15/503 134/166 R
2016/0096971 A1* 4/2016 Papke ..... C09D 175/04 428/412
2017/0135553 A1* 5/2017 Mesa ..... A47L 15/50
2017/0143166 A1* 5/2017 Kareesan ..... A47K 1/09
2017/0258294 A1* 9/2017 Mesa ..... A47L 15/505
2018/0035865 A1* 2/2018 Citak ..... A47L 15/505

FOREIGN PATENT DOCUMENTS

DE 30 22 484 A1 1/1982
DE 92 16 330 U1 4/1994
DE 94 07 327 U1 7/1994
DE 94 21 847 U1 11/1996
DE 297 11 822 U1 10/1998
DE 297 20 069 U1 3/1999
DE 299 02 157 UI 5/1999
DE 298 22 086 U1 6/1999
DE 200 05 725 U1 8/2000
DE 102006012454 A1 11/2006
EP 1 356 761 A2 10/2003
EP 1 424 035 A1 6/2004
EP 1 683 465 A1 7/2006
EP 1 925 251 A2 5/2008
EP 1 929 928 A1 6/2008
EP 1929928 A1 * 6/2008 ..... A47L 15/503
EP 2 245 975 A1 11/2010
EP 2 353 488 A1 8/2011
EP 2 554 099 A2 2/2013
EP 2 554 101 A1 2/2013
EP 2 777 475 A1 9/2014
FR 2152375 A1 4/1973
GB 1393054 A 5/1975
GB 2321394 A 7/1989
WO WO 2005/042212 A1 5/2005
WO WO 2007/057135 A1 5/2007
WO WO 2009/097139 A1 8/2009
WO WO 2013/045543 A1 4/2013
WO WO 2013/098009 A1 7/2013
WO WO 2014/094898 A1 6/2014
WO WO 2014/108079 A1 7/2014

OTHER PUBLICATIONS

Office Action for U.S. Appl. No. 14/654,980 dated Jul. 1, 2016.
Notice of Allowance for U.S. Appl. No. 14/654,980 dated Dec. 6, 2016.
Office Action for Chinese Application No. 201280078146.7 dated Oct. 10, 2016.
International Search Report and Written Opinion for Application No. PCT/EP2014/068527 dated Nov. 26, 2014.
International Search Report and Written Opinion for Application No. PCT/EP2014/068528 dated May 11, 2015.
International Search Report and Written Opinion for Application No. PCT/EP2014/068529 dated May 7, 2015.
Office Action for Chinese Application No. 201480080777.1 dated Jun. 29, 2018, 9 pages.
Office Action for Chinese Application No. 201480080777.1 dated Feb. 26, 2019, 12 pages.

* cited by examiner

SUPPORT ASSEMBLY

TECHNICAL FIELD

The embodiments herein relates to a support assembly for supporting one or more objects in a dishwasher. The embodiments herein also relates to a rack of a dishwasher and a dishwasher comprising a rack.

BACKGROUND

Interior environments of today's dishwashers are not always adapted to receive delicate items such as wine glasses, champagne glasses etc. The interior of a dishwasher is usually designed to receive plates and it is desirably if the interior is robust enough to receive heavy and bulky cookware, such as pots and pans. Therefore, problems may arise when delicate items such as wine glasses, champagne glasses etc., are loaded into such an interior. An option is to dish such delicate items by hand, but dishwashing by hand is time consuming and many users also consider such activities to be burdensome.

Support assemblies have been provided which are intended to support items to be washed within a dishwasher. One such assembly is for example described in the document EP 2245975 A1. However, the support assemblies provided have not satisfactorily solved the above mentioned problems.

Therefore, in view of above, there is a need for an improved support assembly which may overcome some of the above mentioned problems.

SUMMARY

An object of the embodiments herein is to provide an improved support assembly.

According to an aspect of the embodiments herein, the object is achieved by a support assembly for supporting one or more objects in a dishwasher, where the support assembly comprises a snap arrangement, comprising snap fittings for snapping the snap arrangement onto a rack of the dishwasher, where the support assembly further comprises a main frame having a first side and a second side, where the first side is provided with a soft surface structure, and where the main frame is foldably arranged to the snap arrangement to allow the main frame to be folded between at least a supporting position and a storing position, where the soft surface structure of the first side is arranged to support a portion of the one or more objects when the main frame is in the supporting position. Since the soft surface structure of the first side is arranged to support a portion of the one or more objects when the main frame is in the supporting position, delicate items, such as glasses can be supported by the support assembly, without, or almost without, risk of breaking the delicate items. Thereby, an improved support assembly is provided.

Optionally, the main frame is arranged to be stored at the storing position to allow access to the rack. Thereby, a user may choose to use the first side, provided with the soft surface structure, to provide support to delicate items, such as glasses, or to fold the main frame to the storing position to thereby allow access to the rack such that it can accommodate other types of items to be washed, such as plates or cookware, such as pots and pans.

Optionally, the soft surface structure comprises a set of protrusions in an elastic material. In this manner, supporting of delicate items such as glasses may be further improved, since the set of protrusions may improve contacting, or grip, between the soft surface structure and the delicate items.

Optionally, an angle a between the supporting position and the storing position is approximately 180 degrees. In this manner, the soft surface structure of the first side may provide good support of the one or more objects when the main frame is in the supporting position, and at the same time, access may be allowed to the rack when the main frame is in the storing position.

Optionally, the support assembly further comprises a gripping unit frame, where the gripping unit frame comprises one or more gripping units where each gripping unit of the one or more gripping units is arranged to grip a respective stemmed portion of one of the one or more objects. In this manner, supporting of stemmed objects, such as wine glasses or champagne flutes, may be further improved. Thereby, such delicate items may also be better protected from damages caused by a user handling a rack of a dishwasher in a rough way.

Optionally, the gripping unit frame is foldable between at least a folded position and a gripping position. Thereby, a support assembly is provided where the gripping unit frame may be folded to a folded position when it is not in use to thereby provide space to other form of items to be washed than stemmed objects, and which may be folded to the gripping position when it is to be used to grip stemmed portions of stemmed objects. Thereby, a flexible support assembly is provided.

Optionally, each gripping unit has a gripping mode and a releasing mode where the each gripping unit is arranged to release the respective stemmed portion in the releasing mode, and where the each gripping unit is arranged to grip the respective stemmed portion in the gripping mode. Since each gripping unit has a gripping mode and a releasing mode, gripping of one or more stemmed objects may be ensured and removement of the one or more stemmed objects from the gripping unit frame may be facilitated.

Optionally, each gripping unit comprises a first arm and a second arm and a flexible strip arranged between the first and second arms. Since each gripping unit comprises a first arm and a second arm and a flexible strip arranged between the first and second arms, gripping of the one or more stemmed objects may be further improved.

Optionally, the flexible strip is arranged to at least partially enclose the stemmed portion of one of the one or more stemmed objects when the gripping unit is in the gripping mode. Since the flexible strip is arranged to at least partially enclose the stemmed portion when each gripping unit is in the gripping mode, gripping of the one or more stemmed objects may be further improved.

Optionally, the first arm and the second arm are rotatably arranged at the gripping unit frame and where a tip of the first arm and a tip of the second arm are arranged to be closer to each other when the gripping unit is in the gripping mode than in the releasing mode. Thereby, gripping of a stemmed portion of a stemmed object may be further improved.

Optionally, the support assembly is arranged to be snapped onto a lower rack of a dishwasher. Thereby, a support assembly is provided allowing delicate items such as wine glasses and champagne flutes to be accommodated in a lower rack of a dishwasher in a safe manner.

According to a second aspect of the embodiments herein, the object is achieved by a rack of a dishwasher comprising a support assembly according to some embodiments herein.

Optionally, the rack further comprises elongated tines foldably arranged to the rack to allow the elongated tines to be folded between at least an upright position and a folded position where the elongated tines are arranged to support items to be washed, such as plates, in the upright position, and where the folded position constitutes a position in which a main extension of the elongated tines are arranged to substantially coincide with an horizontal extension of the rack, where the tines are arranged to be in the folded position when the main frame is in the supporting position. Thereby, a rack is provided which can provide good support for items to be washed, such as plates, when the tines are in the upright position. At the same time the rack provide space for, and support for, delicate items such as wine glasses and champagne flutes when the tines are in the folded position and when the main frame is in the supporting position. As a result, a flexible rack is provided which is capable of accommodating both items to be washed, such as plates, and delicate items to be washed, such as wine glasses and champagne flutes, in a safe manner.

According to a third aspect of the embodiments herein, the object is achieved by a dishwasher comprising a rack according to some embodiments.

Further features of, and advantages with, the embodiments herein will become apparent when studying the appended claims and the following detailed description. Those skilled in the art will realize that the different features described may be combined to create embodiments other than those described in the following, without departing from the scope of the embodiments herein, as defined by the appended claims.

BRIEF DESCRIPTION OF THE DRAWINGS

The various aspects of the embodiments herein, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout.

Well-known functions or constructions will not necessarily be described in detail for brevity and/or clarity.

Figure 1:
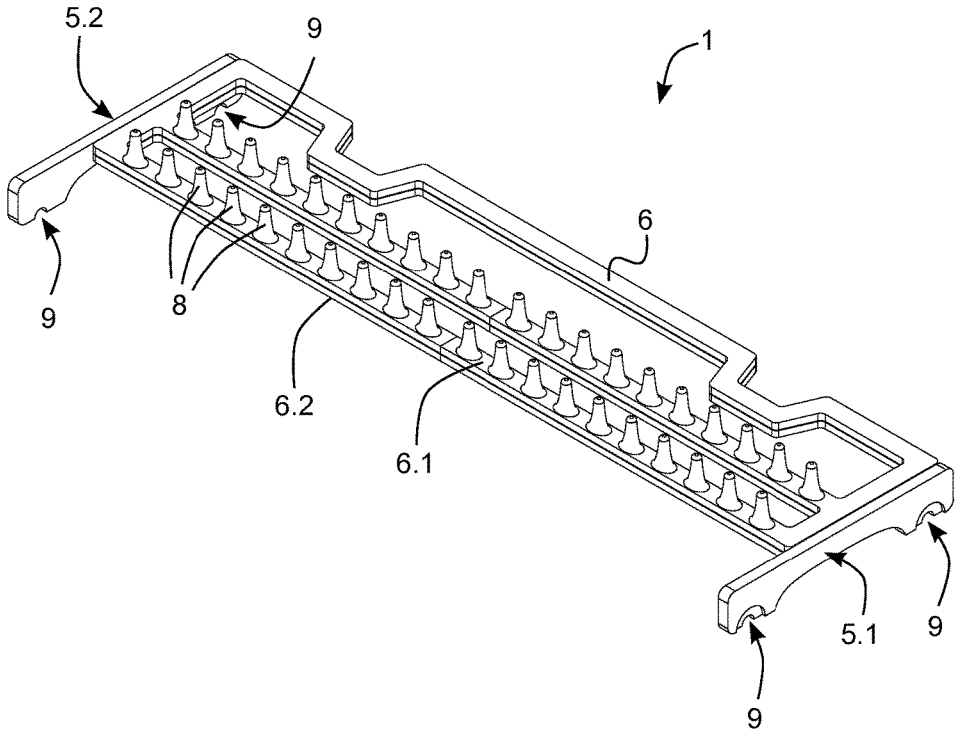
FIG. 1 illustrates a support assembly with a main frame in a supporting position.

FIG. 1 illustrates a support assembly 1 for supporting one or more objects in a dishwasher. The support assembly 1 comprises a snap arrangement 5.1, 5.2 comprising snap fittings 9 for snapping the snap arrangement 5.1, 5.2 onto a rack of the dishwasher. The support assembly 1 further comprises a main frame 6 having a first side 6.1 and a second side 6.2, where the first side 6.1 is provided with a soft surface structure. The main frame 6 is foldably arranged to the snap arrangement 5.1, 5.2 to allow the main frame 6 to be folded between at least a supporting position and a storing position. The main frame 6 of the support assembly 1 illustrated in FIG. 1 is in the supporting position. As can be seen, the first side 6.1 which is provided with a soft surface structure is facing upwards in FIG. 1. The soft surface structure of the first side 6.1 is arranged to support a portion of the one or more objects when the main frame 6 is in the supporting position.

The soft surface structure comprises a set of protrusions 8 in an elastic material. The elastic material may be a ThermoPlastic Elastomers (TPE). Such elastic material may be moulded over Polypropylene (PP). In such embodiments, the ThermoPlastic Elastomers (TPE) may provide elasticity and the PolyPropylene (PP) may provide structure and rigidity. Due to these features, support may be further improved. In particular, support for delicate items, such as wine glasses or champagne flutes, may be improved.

The snap arrangement 5.1, 5.2 may comprise a first bar and a second bar, each comprising snap fittings 9 allowing them to be snapped onto a rack of a dishwasher. The snap fittings 9 may comprise semi-circular apertures having radiuses essentially corresponding to radiuses of wires of a rack onto which the support assembly 1 is arranged to be snapped. The snap arrangement 5.1, 5.2, as well as the main frame 6, may be provided in a plastic material such as Polypropylene (PP) or Polyoxymethylene (POM).

Figure 2:
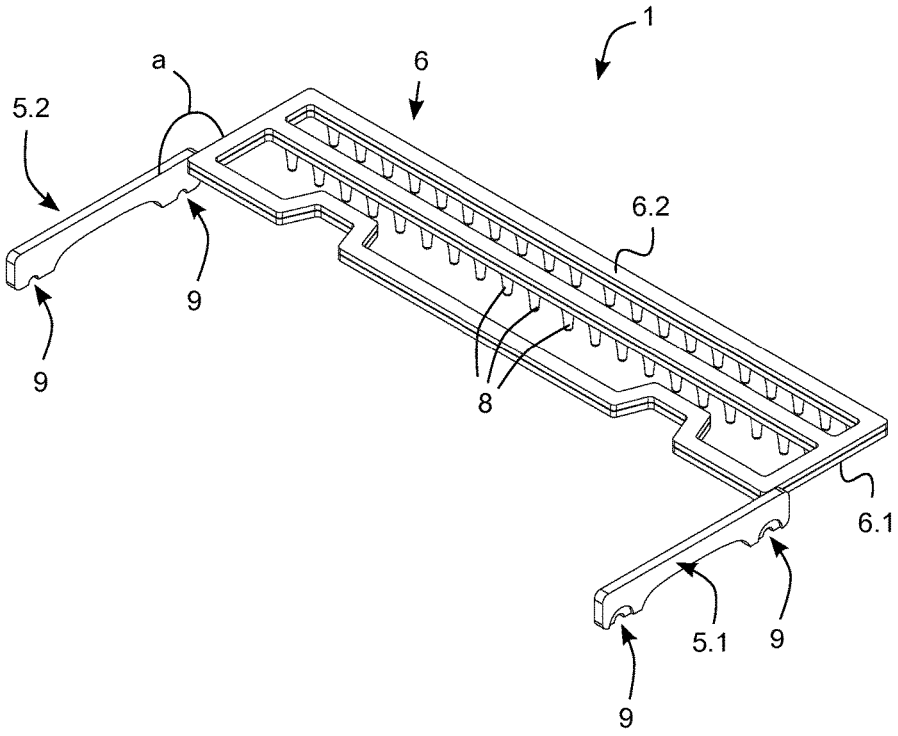
FIG. 2 illustrates the support assembly illustrated in FIG. 1 with the main frame in a storing position.

FIG. 2 illustrates the support assembly 1 illustrated in FIG. 1 with the main frame 6 in the storing position. As can be seen, the angle a between the supporting position and the storing position is approximately 180 degrees. Thereby, the first side 6.1, provided with the soft surface structure, faces upwards to thereby support a portion of the one or more objects when the mainframe 6 is in the supporting position, as illustrated in FIG. 1. Correspondingly, as illustrated in FIG. 2, the first side 6.1, provided with the soft surface structure, faces downwards to thereby protect the soft surface structure when the mainframe 6 is in the storing position. The second side 6.2 may be provided with a rigid surface structure and the second side 6.2 may be arranged to serve as a rigid floor for items to be washed when the main frame 6 is in the storing position.

Further, in embodiments where the soft surface structure comprises a set of protrusions 8 in an elastic material, these face upwards when the main frame 6 is in the supporting position and these face downwards when the main frame 6 is in the storing position. As a result, the support assembly 1 may provide good support for delicate items when the main frame 6 is in the supporting position and the support assembly 1 may provide access to the rack, and/or serve as a rigid floor for items to be washed, when the main frame 6 is in the storing position. Accordingly, a support assembly 1 is provided capable of providing support for both delicate items and heavy and bulky cookware such as pots and pans.

Figure 3:
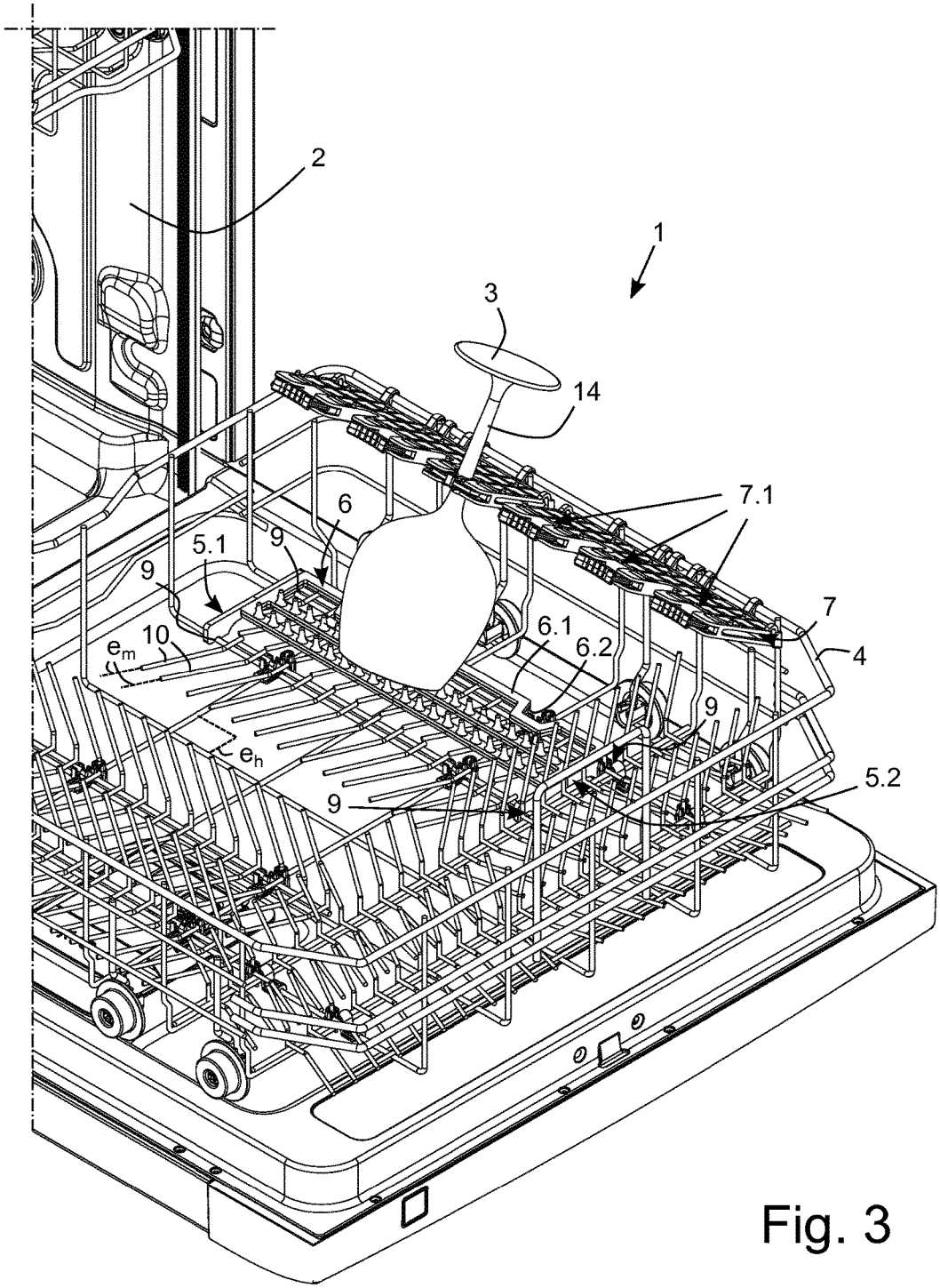
FIG. 3 illustrates a rack of a dishwasher comprising a support assembly according to some embodiments.

FIG. 3 illustrates a rack 4 of a dishwasher 2 comprising a support assembly 1 according to some embodiments. The support assembly 1 comprises a snap arrangement 5.1, 5.2 comprising snap fittings 9 for snapping the snap arrangement 5.1, 5.2 onto the rack 4 of the dishwasher 2. The support assembly 1 comprises a main frame 6 having a first side 6.1 and a second side 6.2. The main frame 6 of the support assembly 1 illustrated in FIG. 3 is in the supporting position. As can be seen, the soft surface structure of the first side 6.1 provides support for a portion of an object 3, in the form of a wine glass.

The support assembly 1 further comprises a gripping unit frame 7. The gripping unit frame 7 comprises one or more gripping units 7.1 where each gripping unit 7.1 of the one or more gripping units 7.1 is arranged to grip a respective stemmed portion 14 of one of the one or more objects 3.

Thereby, good support for stemmed objects 3, such as wine glasses or champagne flutes, may be provided, even in cases where a user handles the rack 4 in a rough way, or careless way.

The rack 4 further comprises elongated tines 10 foldably arranged to the rack 4 to allow the elongated tines 10 to be folded between at least an upright position and a folded position. The elongated tines 10 are arranged to support dishes, such as plates, in the upright position. In FIG. 3, the tines 10 are illustrated in the folded position. As can be seen, the folded position constitutes a position in which a main extension $e_m$ of the elongated tines 10 are arranged to substantially coincide with an horizontal extension $e_h$ of the rack 4. The tines 10 are arranged to be in the folded position when the main frame 6 is in the supporting position. Thereby, space is provided for the main frame 6 such that the soft surface structure of the first side 6.1 of the main frame 6 may support portions the one or more objects 3.

The gripping unit frame 7 is foldable between at least a folded position and a gripping position. In FIG. 3, the gripping unit frame 7 is in the gripping position.

Figure 4:
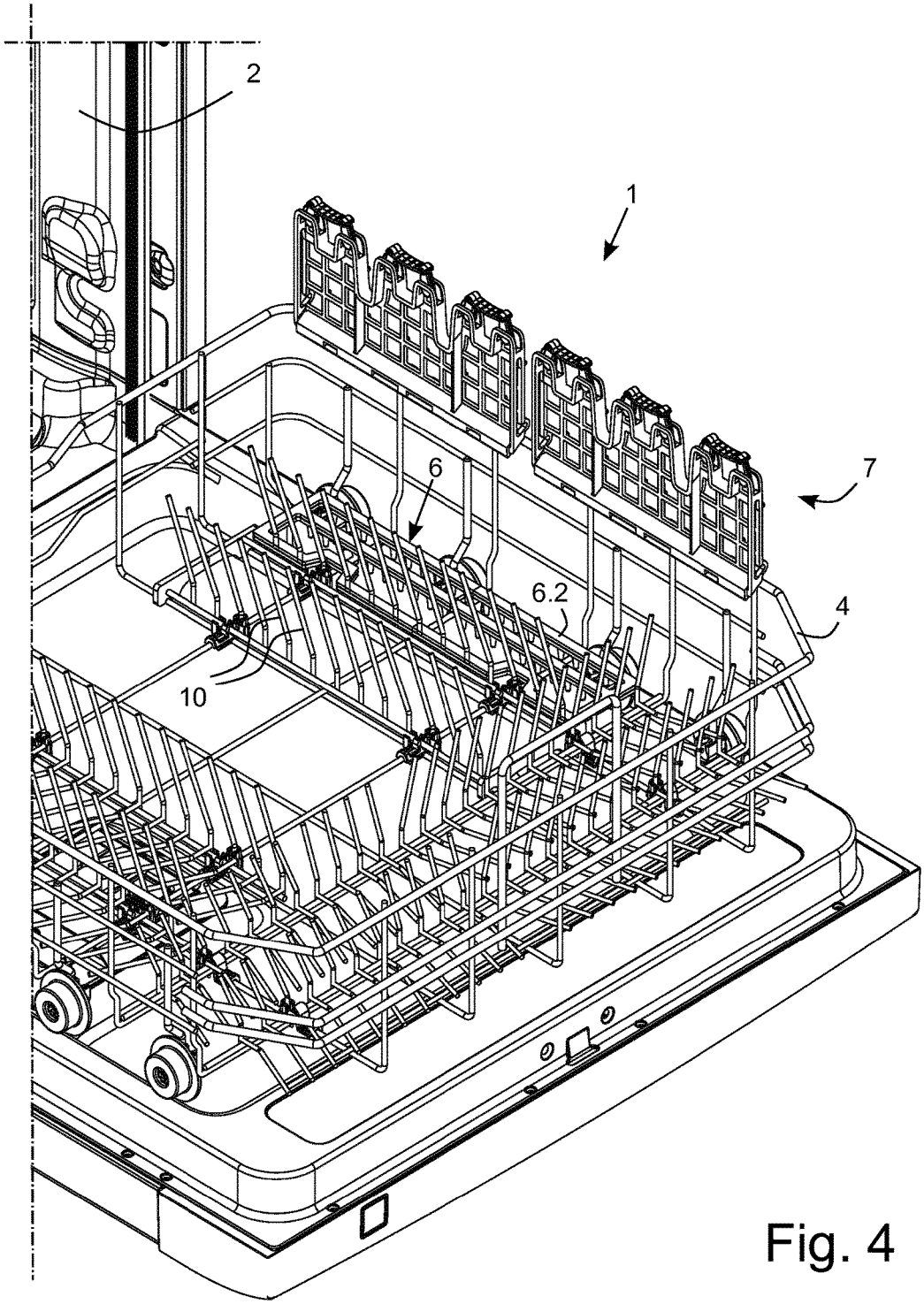
FIG. 4 illustrates the rack of the dishwasher illustrated in FIG. 3 where a gripping unit frame is in a folded position.

FIG. 4 illustrates the rack 4 of the dishwasher 2 illustrated in FIG. 3 where the gripping unit frame 7 is in the folded position. As illustrated, the gripping unit frame 7 may be tilted upwards to the folded position to thereby provide space for other form of items to be washed than stemmed objects within the rack 4. Also, as can be seen in FIG. 4, the tines 10 of the rack 4 has been folded to an upright position in FIG. 4 in comparison to the tines 10 illustrated in FIG. 3. Thereby, flat items to be washed, such as plates, can be accommodated in the rack 4 when the main frame 6 is in the storing position. Also, as illustrated in FIG. 4, the main frame 6 is arranged to be stored at said storing position to allow access to the rack 4 and the storing position constitutes a position in an outer portion of the rack 4.

As illustrated in FIG. 3 and FIG. 4, the support assembly 1 may be arranged to be snapped onto a lower rack 4 of a dishwasher 2. Thereby, also the lower rack 4 of the dishwasher 2 may be utilized to accommodate delicate items such as wine glasses or champagne glasses in a safe manner.

As illustrated in FIG. 3, each gripping unit 7.1 of the gripping unit frame 7 has a gripping mode and a releasing mode where the each gripping unit 7.1 is arranged to release the respective stemmed portion 14 in the releasing mode, and where the each gripping unit 7.1 is arranged to grip the respective stemmed portion 14 in the gripping mode.

Figure 5:
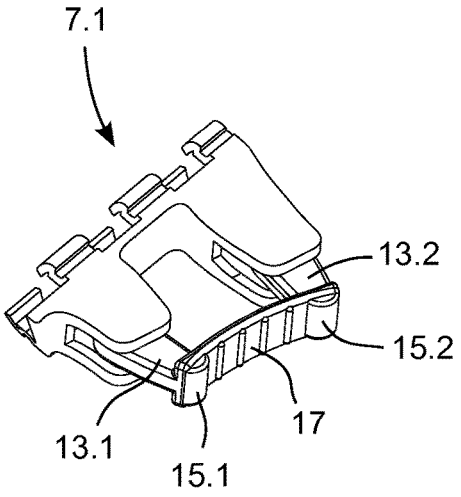
FIG. 5 illustrates a gripping unit in a releasing mode.

FIG. 5 illustrates a gripping unit 7.1 in a releasing mode. The gripping unit 7.1 comprises a first arm 13.1 and a second arm 13.2 and a flexible strip 17 arranged between the first and second arms 13.1, 13.2. The first arm 13.1 and the second arm 13.2 are rotably arranged with respect to the gripping unit frame 7 of the holding assembly.

Figure 6:
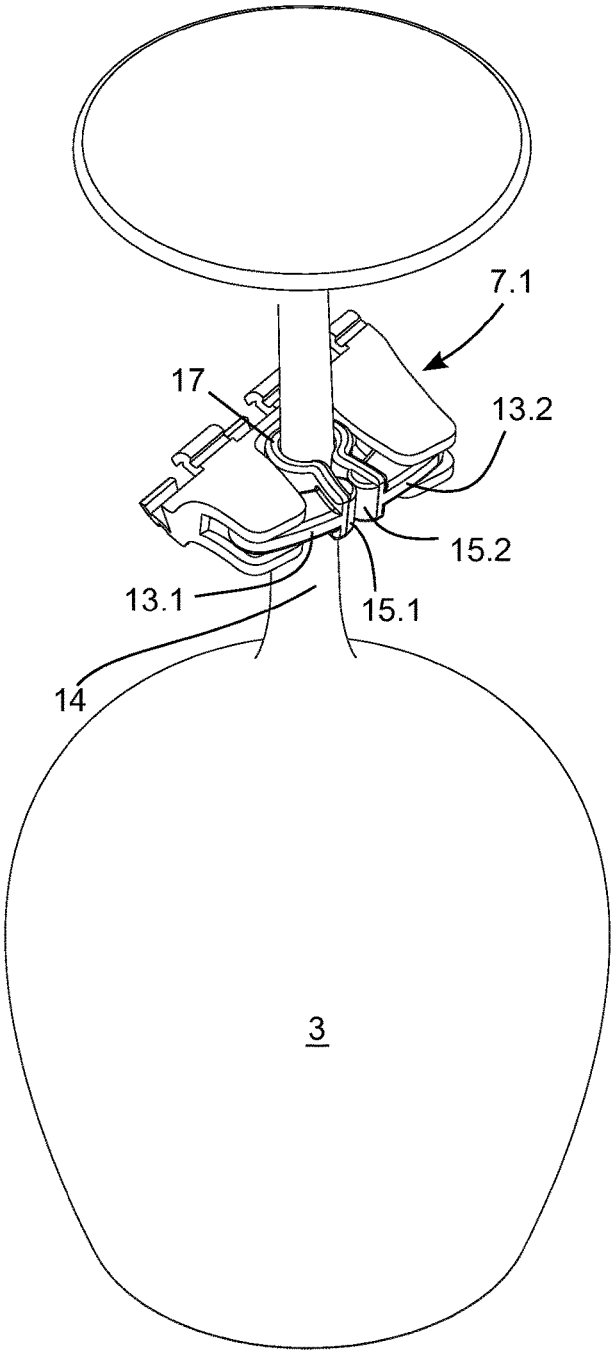
FIG. 6 illustrates the gripping unit illustrated in FIG. 5 in a gripping mode.

FIG. 6 illustrates the gripping unit illustrated in FIG. 5 in a gripping mode. As illustrated in FIG. 5, the flexible strip 17 is arranged to at least partially enclose a stemmed portion 14 of a stemmed object 3, when the gripping unit 7.1 is in the gripping mode.

Also, as can be seen in FIG. 5 and FIG. 6, a tip 15.1 of the first arm 13.1 and a tip 15.2 of the second arm 13.2 are arranged to be closer to each other when the gripping unit 7.1 is in the gripping mode than when the gripping unit is in the releasing mode.

The flexible strip 17 and/or the first arm 13.1 and the second arm 13.2 may be provided in a soft material. The soft material may be a ThermoPlastic Elastomer (TPE).

Due to these features, gripping of a stemmed portion 14 of a stemmed object 3 may be secured, even in cases where a user handles a rack in a rough way.

It is to be understood that the foregoing is illustrative of various example embodiments and the embodiments herein is not to be limited to the specific embodiments disclosed and that modifications to the disclosed embodiments, combinations of features of disclosed embodiments as well as other embodiments are intended to be included within the scope of the appended claims.

The invention claimed is:

1. A dishwasher rack assembly comprising:

a dishwasher rack defining a rack bottom having a plurality of wires, and side walls which are generally perpendicular relative to the rack bottom; and a support assembly for supporting one or more objects in the dishwasher rack within a dishwasher, wherein said support assembly comprises:

a pair of opposing side bars, wherein each side bar has a top surface, a bottom surface, a center, a distal end, and a proximal end, wherein the bottom surfaces each comprise snap fitting notches therein, wherein the snap fitting notches directly engage corresponding wires from said plurality of wires of the rack bottom to snap the support assembly onto the rack bottom, and a generally planar main frame having a first side, an opposing second side, a first end and an opposing second end, wherein said main frame is pivotably attached to said pair of opposing side bars at a location between each center and each distal end respectively along a single axis to connect the side bars to each other and to allow said main frame to pivot between at least a supporting position and a storing position while the snap fitting notches are engaged with the rack bottom, wherein the main frame only pivots relative to the pair of opposing side bars along said single axis;

wherein, in the supporting position, the first side defines a top surface of the main frame and the second side defines a bottom surface of the main frame, wherein the bottom surface of the main frame is closer to the rack bottom than the top surface of the main frame, and said first side is configured to support said one or more objects thereon; and wherein, in the storing position, the first side defines the bottom surface of the main frame and the second side defines the top surface of the main frame, wherein the bottom surface of the main frame is closer to the rack bottom than the top surface of the main frame, and wherein said second side of the main frame is configured to support said one or more objects thereon, wherein an angle (a) between said supporting position and said storing position is approximately 180 degrees.

2. The dishwasher rack assembly according to claim 1, wherein said main frame is configured to be stored at said storing position to allow access to the rack bottom.

3. The dishwasher rack assembly according to claim 1, wherein said first side of the main frame is provided with a soft surface and said second side of the main frame defines a hard surface that is harder than the soft surface, wherein the soft surface comprises a set of protrusions at least partially covered by an elastic material.

4. The dishwasher rack assembly according to claim 1, further comprising a gripping unit frame configured to be attached to a corresponding side wall from said side walls of the dishwasher rack, wherein the gripping unit frame is spaced apart from the support assembly, wherein said gripping unit frame comprises one or more gripping units, wherein each gripping unit of said one or more gripping units is configured to grip a respective stemmed portion of one of said one or more objects while a respective rim portion of said one of said one or more objects rests on the main frame of the support assembly in the supporting position.

5. The dishwasher rack assembly according to claim 4, wherein said gripping unit frame is rotatable between at least a stored position and a gripping position.

6. The dishwasher rack assembly according to claim 4, wherein each gripping unit has a gripping mode and a releasing mode, wherein each gripping unit is configured to release each respective stemmed portion respectively in said releasing mode, and wherein each gripping unit is configured to grip each respective stemmed portion respectively in said gripping mode.

7. The dishwasher rack assembly according to claim 6, wherein each gripping unit comprises a first arm, a second arm, and a flexible strip arranged between said first and second arms.

8. The dishwasher rack assembly according to claim 7 wherein each flexible strip is configured to at least partially enclose each respective stemmed portion respectively when each gripping unit is in said gripping mode.

9. The dishwasher rack assembly according to claim 7, wherein said first arm and said second arm are configured to rotate with respect to the gripping unit frame, wherein a tip of a corresponding first arm and a tip of a corresponding second arm from a corresponding gripping unit from said one or more gripping units are configured to be closer to each other when said corresponding gripping unit from said one or more gripping units is in said gripping mode than in said releasing mode.

10. The dishwasher rack assembly according to claim 1, wherein, when in use, the dishwasher rack is a lower dishwasher rack of the dishwasher and the lower dishwasher rack includes one or more wheels.

11. The dishwasher rack assembly according to claim 1, wherein said dishwasher rack further comprises elongated tines configured to be rotatably attached to said dishwasher rack to allow said elongated tines to be rotated between at least an upright position and a collapsed position, wherein said elongated tines are configured to support items to be washed in said upright position, wherein, in said collapsed position, the elongated tines are configured to be generally parallel to the rack bottom, and wherein said elongated tines are configured to be urged toward said collapsed position by pivoting said main frame from said storing position to said supporting position.

12. A dishwasher comprising the dishwasher rack assembly according to claim 1.

13. The dishwasher rack assembly according to claim 1, wherein said first side is configured to rest on the rack bottom when the main frame is in the storing position.

14. The dishwasher rack assembly according to claim 1, wherein said second side is at least partially supported by a collapsed elongated tine when the main frame is in said supporting position.

15. The dishwasher rack assembly according to claim 1, wherein said main frame is configured to rest on different portions of the dishwasher rack in the respective supporting position and storing position while the pair of opposing side bars each remain in a same position.

16. The dishwasher rack assembly according to claim 1, wherein the single axis is defined off-center relative to a geometric center of the main frame, such that the main frame is configured to pivot between the supporting position and the storing position without moving the pair of opposing side bars.

17. The dishwasher rack assembly according to claim 1, wherein the pair of opposing side bars comprise a first bar configured to span at least two parallel wires from said plurality of wires of the rack bottom, wherein the snap fitting notches of the first bar comprise a first snap fitting notch and a second snap fitting notch, wherein the first snap fitting notch is configured to engage a first wire from said at least two parallel wires, where the second snap fitting notch is configured to engage a second wire from said at least two parallel wires, where the main frame is configured to pivot about the single axis parallel to the at least two parallel wires, and wherein the single axis is defined off-center relative to the first snap fitting notch and the second snap fitting notch.

18. The dishwasher rack assembly according to claim 17, wherein a second axis is defined between the first snap fitting notch and the second snap fitting notch, wherein a plurality of elongated tines, extending generally perpendicular to the at least two parallel wires and generally perpendicular relative to the second axis, are placed between the pair of opposing side bars without impinging the main frame in at least the storing position.

19. The dishwasher rack assembly according to claim 17, wherein the pair of side bars comprise a second bar, disposed parallel to the first bar, which is configured to span the at least two parallel wires of the rack bottom.

20. A rack assembly comprising:

a dishwasher rack, wherein the dishwasher rack defines a rack bottom having a plurality of wires, and side walls which are generally perpendicular relative to the rack bottom;

a support assembly for supporting one or more objects in the dishwasher rack, wherein the support assembly comprises:

a snap arrangement comprising:

a pair of opposing side bars comprising a first side bar and a second side bar, wherein each side bar has a top surface, a bottom surface, a center, a distal end, and a proximal end;

wherein the bottom surface of the first side bar has a first snap fitting notch and a second snap fitting notch therein; and the bottom surface of the second bar has a third snap fitting notch and a fourth snap fitting notch therein, wherein the first snap fitting notch and the third snap fitting notch are each configured to simultaneously engage a first wire of at least two parallel wires from said plurality of wires of the rack bottom, wherein the second snap fitting notch and the fourth snap fitting notch are each configured to simultaneously engage a second wire of the at least two parallel wires from said plurality of wires of the rack bottom to secure the first bar and the second bar to the rack bottom, and a generally planar main frame defining a first side, an opposing second side, a first end, and an opposing second end, wherein the first side has a plurality of protrusions extending generally perpendicularly therefrom, wherein the first end of the main frame is pivotably attached to the distal end of each of the first and the second side bars respectively along a single axis to connect the first side bar and the second side bar together and allow the main frame to be pivoted between at least a supporting position and a storing position about the single axis while each snap fitting notch of the first side bar and the second side bar are engaged with the at least two parallel wires respectively, wherein the single axis is generally parallel to the at least two parallel wires, wherein the main frame only pivots relative to the pair of opposing side bars along said single axis;

wherein, in the supporting position, a majority of the main frame is located in between the pair of opposing side bars, the first side defines a top surface of the main frame and the second side defines a bottom surface of the main frame, wherein the bottom surface of the main frame is closer to the rack bottom than the top surface of the main frame; and wherein, in the storing position, the first end of the main frame is located between the pair of opposing side bars and a majority of the main frame is not located in between the pair of opposing side bars, the first side defines the bottom surface of the main frame and the second side defines the top surface of the main frame, wherein the bottom surface of the main frame is closer to the rack bottom than the top surface of the main frame.

21. The support assembly according to claim 20, wherein the first snap fitting and the second snap fitting define a second axis extending therebetween, and wherein the second snap fitting is disposed between the first snap fitting and the single axis relative to an axial direction of the second axis, such that the support assembly is configured to receive a plurality of tines extending perpendicular to the at least two parallel wires and perpendicular to the second axis without impinging the main frame in at least the storing position with the plurality of tines being disposed between first snap fitting and the third snap fitting and between the second snap fitting and the fourth snap fitting respectively.

* * * * *